US009033766B2

(12) United States Patent
Campbell

(10) Patent No.: US 9,033,766 B2
(45) Date of Patent: May 19, 2015

(54) TOOL FOR SELECTIVE HONING OF A CYLINDERS OUTER-DIAMETER

(71) Applicant: David Rogers Campbell, Richland, WA (US)

(72) Inventor: David Rogers Campbell, Richland, WA (US)

( * ) Notice: Subject to any disclaimer, the term of this patent is extended or adjusted under 35 U.S.C. 154(b) by 202 days.

(21) Appl. No.: 13/987,029

(22) Filed: Jun. 27, 2013

(65) Prior Publication Data

US 2015/0004881 A1 Jan. 1, 2015

(51) Int. Cl.
*B24B 33/04* (2006.01)
*B24B 33/08* (2006.01)

(52) U.S. Cl.
CPC ..... *B24B 33/04* (2013.01); *B24B 33/081* (2013.01); *B24B 33/085* (2013.01)

(58) Field of Classification Search
CPC .... B24B 33/04; B24B 33/022; B24B 33/081; B24B 33/085; B24B 9/021; B24B 21/02; B24B 5/42; B24D 15/026; B24D 9/04; B24D 9/085
USPC ..... 451/508, 510, 520, 519, 59, 499, 496, 451/49, 307, 173, 501, 502; 15/88; 89/14.8
See application file for complete search history.

(56) References Cited

U.S. PATENT DOCUMENTS

| | | | | | |
|---|---|---|---|---|---|
| 1,025,859 | A | * | 5/1912 | Calahan | 451/173 |
| 1,415,664 | A | * | 5/1922 | Lovelace | 451/482 |
| 1,748,313 | A | * | 2/1930 | Steuber | 451/493 |
| 1,905,821 | A | * | 4/1933 | Dunbar et al. | 451/181 |
| 1,928,506 | A | * | 9/1933 | Sellberg et al. | 451/441 |
| 2,045,511 | A | * | 6/1936 | Babcock | 15/220.4 |
| 2,225,272 | A | * | 12/1940 | Horne | 15/4 |
| 2,245,820 | A | * | 6/1941 | Postma | 451/482 |
| 2,474,756 | A | * | 6/1949 | Papciak | 451/482 |
| 2,618,915 | A | * | 11/1952 | Johnson | 451/487 |
| 3,568,376 | A | * | 3/1971 | Slater | 451/439 |
| 5,038,525 | A | * | 8/1991 | Gardner | 451/439 |
| 5,437,125 | A | * | 8/1995 | Barton, II | 451/8 |

* cited by examiner

*Primary Examiner* — Joseph J Hail
*Assistant Examiner* — Arman Milanian

(57) ABSTRACT

A tool is disclosed for selective honing of the outer diameter of a cylinder using an abrasive belt in semi-circular contact upon the outer-diameter of a cylindrical work-piece to perform a similar function to honing the inner-diameter of a hollow cylinder. The belt is retained within the tool body by U-shaped restraint arms, and a slot in the tool body. A clamp block retains the ends of the belt which exit the slot. Springs on the arms, and contact of the block on the outside of the tool body, force the belt into a triangular shape inside the body. A cylindrical work-piece inserted within the triangular shaped belt causes the belt to deform into three semi-circular areas of contact between the belt and work-piece. When the work-piece is rotated, the belt abrades material from the work-piece.

7 Claims, 4 Drawing Sheets

TOOL FOR SELECTIVE HONING OF A CYLINDERS OUTER-DIAMETER

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Honing is a process to finish an object, such as a hole, to a final size, after an imprecise operation such as drilling, and to produce a fine surface finish. Honing is usually on the inner-diameter, but can also be done on the outer-diameter of an object. Grinding is common on outer-diameters, but can be very expensive. Abrasive stones are often used for both inner and outer-diameter honing but are expensive, fragile and come in limited number of grit sizes and lengths. Honing is generally not a selective process—the honed area depends on the length of the stones, and very short stones may not produce a hone finish that is accurate. One example of an inner-diameter hone is U.S. Pat. No. 6,558,240 which is only suitable for inner diameter honing in a narrow range of hone grit sizes. The Sunnen Corporations FB-E external honing body is an outer-diameter honing tool using honing stones, but the tool is for use with a honing machine and only with fine grit honing stones. U.S. Pat. No. 6,669,531 claims honing on multiple surfaces; U.S. Pat. No. 6,074,282 and others claim outer-diameter honing but not on selected areas.

This Invention is directed to the task of honing the outer-diameter of pipe or precision cylindrical tubing, to remove ovality and reduce the outer-diameter to some finished size. Further, it is desired to only work certain sections of the length of the tubing so as to not waste labor and tool life.

Honing tools with abrasive stones are generally limited to removal of very small amounts of material. In this Invention, both small and large amounts of removal are anticipated, upwards of 0.25 mm (0.01") for which sand paper or the like are more appropriate and less expensive. Sanding belts are available in wider grit ranges than honing stones for a wider rate of material removal. Since selective honing is desired, the Invention incorporates sanding belts into an abrading mechanism, where the belt width represents the honed area length. At least two assemblies are preferred to hold the work-piece concentric with the tool body, ensuring the honed areas are concentric. More than two assemblies can be included.

BRIEF SUMMARY OF THE INVENTION

The Invention disclosed herein is a simple, low cost tool for honing the outer-diameter of a cylinder such as precision metal tubing or pipe, using abrasive belts instead of honing stones.

DETAILED DESCRIPTION OF THE INVENTION

Figure 1:
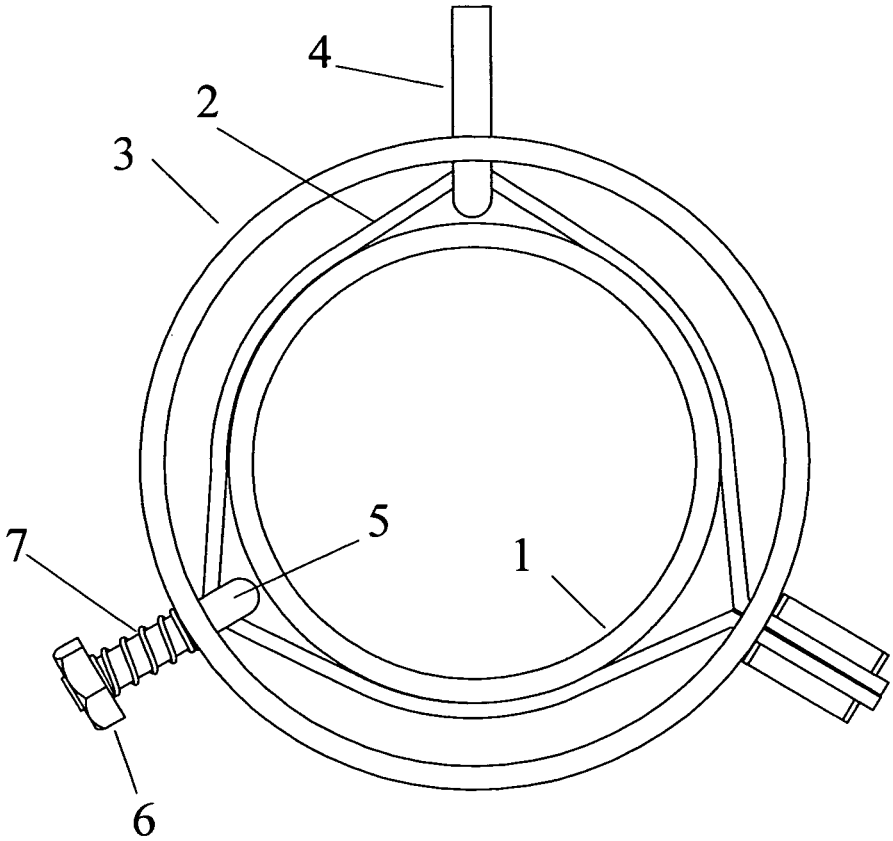
FIG. 1 is a top view of the Invention with work-piece (1) held inside abrasive belt (2) within tool body (3). Restraint arms (4) and (5) are located at two vertices of the triangular shape of (2). One stop (6) and spring (7) are shown on one end of one arm (4), omitted from the other ends of the arms for clarity of the U-arm arrangement.
Figure 2:
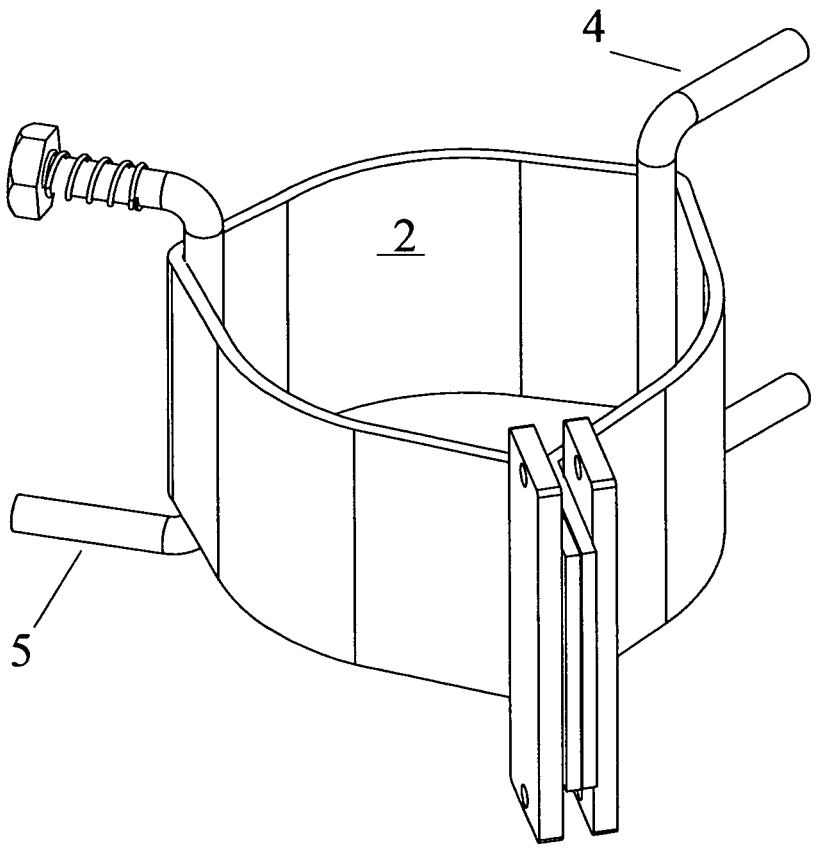
FIG. 2 is an isometric view of the abrasive assembly without (1) and (3). The restraint arms (4) and (5) are in contact with (2).
Figure 3:
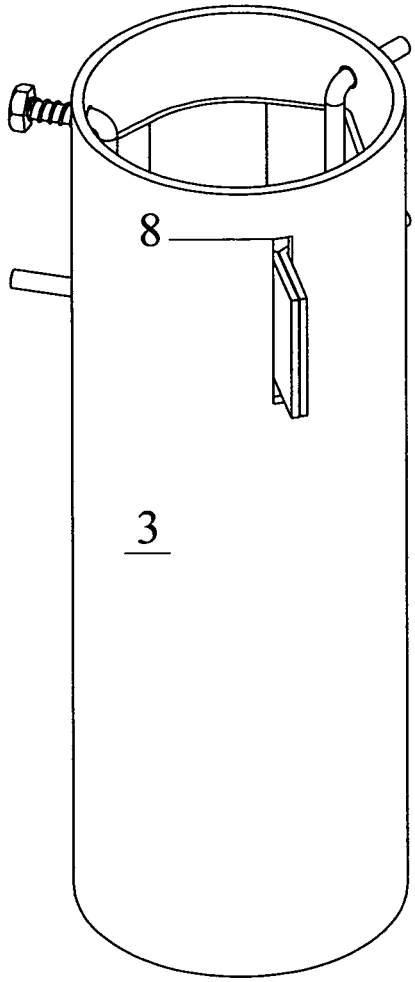
FIG. 3 is an isometric view with (3) included to show the rectangular slot (8) with the ends of (2) passing through (8).
Figure 4:
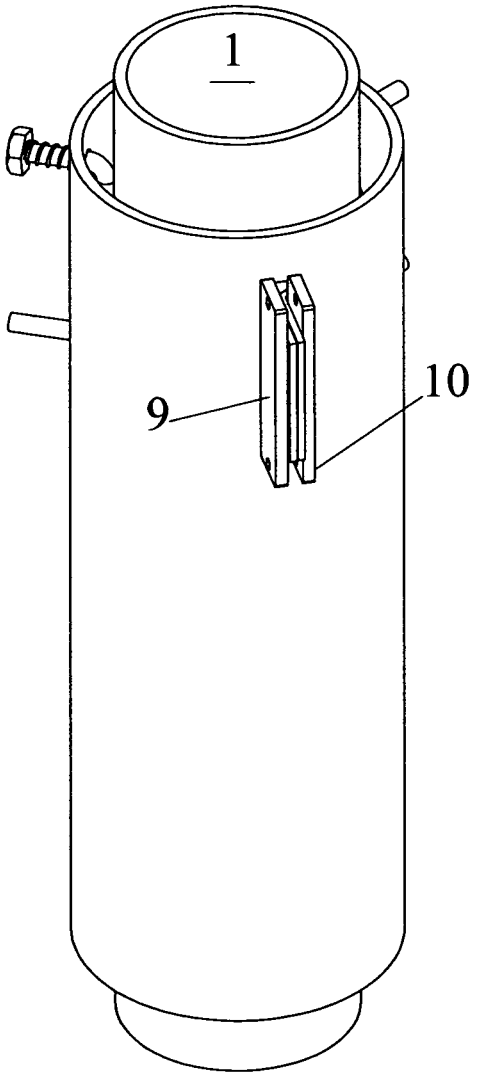
FIG. 4 is an isometric view including the rectangular clamp block halves (9) and (10) which are fastened together against the ends of (2).

Drawn or extruded tubing are much more accurately sized and straighter than pipe, but both may have significant distortion in ovality and diameter due to features such as weld seams or variations in the extrusion process. In some applications such as close fitting telescopic tubing, small errors in ovality and outer-diameter are not acceptable. The errors might be on the order of 0.25 mm. Such amounts of material can be removed by abrasion with sandpaper, which is inexpensive, and available in a wide variety of grits and types.

The goal of this Invention is to work selected areas of a cylindrical tube known as a work-piece. Such relatively large amounts of material removal indicate use of sand paper or belts instead of hone stones which are intended to remove only small amounts of material. Sand paper is fragile, so sanding belts are preferred since they have a cloth backing for strength. Sanding belts are available in various narrow widths useful for selective working of small areas.

Sand paper and belts are relatively fragile compared to grinding discs and the like, so the forces on the belt must be low. If the forces are low, then the contact area between the belt and work-piece must be lower to keep the pressure relatively high. This precludes contact of the belt on the entire diameter of the work-piece. Following the idea of a honing tool with abrasive stones, the belt contact is defined as three relatively narrow areas of contact with the work-piece, indicating a triangular shaped belt.

A round tube of a larger inner-diameter than the work-piece is the tool body. The sanding belt is restrained inside the body on three sides, causing the belt to take a triangular shape. When the work-piece is inserted within the triangular shaped belt, and the outer-diameter of the work-piece is larger than the triangle, the belt is deformed into three, semi-circular contact areas against the work-piece. Since the belt contacts three areas instead of the entire circumference of the work-piece, the pressure on the contact areas is higher. If the contact area and belt force are variable, the pressure of the sanding belt against the work-piece can be varied, allowing accurate control of the material removal rate.

Two belts, one located near each end of the tool body, hold the work-piece concentric with the tool body. Additional belts can be included in the intervening space between the two belts as needed to hone the work-piece.

The tool body may be plastic or metal and its inner-diameter is larger than the outer-diameter of the work-piece. The body is slightly longer than the distance between the furthest-apart areas, on the work-piece, to be honed.

The following describes the construction of each abrading assembly, further assemblies are of the same design. The tool body, near one end, has two sets of two holes drilled through its wall. Each set is along the length of the tool body. Each set is spaced 120 degrees around the circumference of the body from each other. The size of the holes are slightly larger than the diameter of the restraint arms described below.

At the remaining 120 degree position, a narrow, elongated slot is milled through the body wall, along the length of the tool body. The slot is about the same length as the spacing of the sets of holes. The length of the slot is slightly longer than the width of the belt, and the width of the slot is slightly wider than twice the thickness of the belt, plus clearance to allow the ends of the belt to be easily passed through the slot from inside the tube.

A U-shaped restraint arm is placed with its ends through each set of holes, one arm through each set of holes, with the arms arranged along the length of the body. The arms are longer than the width of the sanding belt, so that if the belt is wrapped around the inside of the U-shape, it lies flat against the arm. The ends of the arms are passed through the tool body wall from the inside. The inside of the U shaped arms are held against the inside of the body by extension springs and stops on the end of each arm. The springs are between the outer-diameter of the body and the stops on the end of the arms. The stops can be nuts upon threaded ends of the arms to allow adjustment of the spring force.

The sanding belt is passed through the slot from the outside of the body, and around the inside of the body, passing between each of the restraint arms and the body, then exits the body though the slot. The smooth side of the belt is towards the body.

The ends of the belt are held together, pulled radially away from the body, then clamped together with a clamp block. The ends of the belt are clamped together within the block. The block is located in contact with the outside of the body.

With the clamp block resting against the body, having been placed there with tension on the ends of the sanding belt, the belt is in tension with respect to the two restraint arms, and held within the body in a triangular shape. The belts vertices are in contact with the two arms, and the rectangular slot. The belt tension is determined by the spring rate of the restraint arms springs, and the amount of compression of the springs due to the belt ends being pulled away from the body.

When the work-piece is inserted within the triangular shaped belt, the sides of belt are forced outward resulting in the spring force and belt tension increasing as the restraint arms are forced inwards. The contact between the belt and work-piece is three areas in a semi-circular shape, the area of the contact is a function of the width of the belt, and the length of the contact-arc.

When the work-piece is rotated, material is abraded from the outer surface of the work-piece by the abrasive grit on the belt. The removal rate is a function of belt grit size, belt contact area, force of the belt against the work-piece as determined by the restraint arms spring force, and speed of the work-piece rotation. The material removal rate and service life of the belt can be approximated by finding the wear rate of an equivalent system of flat sanding belt against a flat surface.

When the belt wears beyond its service limit, the clamp block is loosened and belt redistributed inside the body to place new grit surfaces against the work-piece, then the clamp block is tightened. If the material removal requires use of subsequently finer grits, the belt is removed and replaced by a belt with finer grit.

The abrading assembly above can be repeated along the length of the tool body to simultaneously hone multiple areas along the length of the work-piece. It is assumed that at least two belts are in contact with the work-piece so the work-piece is held concentric with the body and belts, so that the material removal is the same on all areas to be honed. This also assumes the spring force is equal for all restraint arms, and all belt ends are pulled the same distance from the body, resulting in the same tension in all belts.

The above design assumes that all belt-ends exit the body at the same degree angle around the body circumference. The ends can also exit at different angles, the angle depending on the arrangement that generates the best finish on the work-piece. The belts could abrade the ovality on one of three areas on the work-piece at a time, or two or three at once.

The inventor claims:

1. A tool to hone the outer-diameter of a cylindrical work-piece, comprising:

a tool body comprising a hollow cylinder;

an abrading assembly within said body comprising:

an abrasive belt, being a sanding belt or similar abrasive device, constrained within said body;

a plurality of restraint arms, each in a U-shape, within said body, whose ends pass radially outward through said body, with their lengths arranged along the axial length of said body;

wherein said belt is radially disposed about the inside of said body in a triangular shape with respect to the end of said body;

said body having a rectangular slot along the axial length of said body;

said belt having two parallel ends exiting radially through said slot;

a rectangular clamp block whose length is coincident with said slot, comprising two clamping halves forced together with screws or other ordinary mechanical devices;

said two parallel ends clamped together between said halves;

said block with said two parallel ends clamped therein in contact with the outside of said body so that said ends cannot move inward through said slot;

a stop at each end of said arms;

an extension spring about each end of said arms between each of said stops and the outer surface of said body;

wherein compression of each of said springs against said body forces each end of said arms radially outward from said body, causes said arms to apply radial force to the inside of said belt such that said belt is in tension, and the contact between said block and said body is in compression;

wherein said belt is restrained in to a triangular shape having three sides by said arms and said slot.

2. The tool according to claim 1, further comprising two of said assembly wherein each assembly is located at each end of said body.

3. The tool according to claim 2, wherein said ends of both assemblies are aligned with respect to one another when viewed from end surfaces of said body.

4. The tool according to claim 1, wherein said ends exist said body at a 120 degree angle with respect to each other.

5. The tool according to claim 1, wherein said workpiece is concentrically disposed within said body by contact between said work piece outer diameter and said side of said belt.

6. The tool according to claim 1, wherein said contact between the workpiece and said belt deforms said sides into a semi-circular shape in contact with the outer diameter of said work-piece.

7. The tool according to claim 1, wherein the area of said contact between the work piece and said belt is a function of width of said belt, the difference in diameter between the outer diameter of said work piece and the inner diameter of said body, and the tension of said springs.

* * * * *